US008550281B2

(12) United States Patent
Williamson

(10) Patent No.: US 8,550,281 B2
(45) Date of Patent: Oct. 8, 2013

(54) PORTABLE SAFETY DISH

(75) Inventor: Nelson Todd Williamson, Brooklyn, NY (US)

(73) Assignee: Nelson, Khalil & Kayden Corporation, Brooklyn, NY (US)

( * ) Notice: Subject to any disclaimer, the term of this patent is extended or adjusted under 35 U.S.C. 154(b) by 7 days.

(21) Appl. No.: 13/474,368

(22) Filed: May 17, 2012

(65) Prior Publication Data

US 2012/0228161 A1 Sep. 13, 2012

Related U.S. Application Data

(63) Continuation-in-part of application No. 12/327,281, filed on Dec. 3, 2008, now Pat. No. 8,201,705.

(60) Provisional application No. 60/992,017, filed on Dec. 3, 2007.

(51) Int. Cl.
*B65D 55/14* (2006.01)

(52) U.S. Cl.
USPC ..... 220/210; 220/574.1; 220/575; 206/1.5; 70/3; 70/158

(58) Field of Classification Search
USPC ..... 220/210, 574.1, 575; 206/1.5; 70/3, 158
See application file for complete search history.

(56) References Cited

U.S. PATENT DOCUMENTS

| | | | | |
|---|---|---|---|---|
| 3,107,027 | A | 10/1963 | Hong | |
| 3,610,177 | A | 10/1971 | Shapiro | |
| 4,796,768 | A | 1/1989 | Stuckey | |
| 4,834,251 | A | 5/1989 | Yu | |
| 5,325,969 | A | 7/1994 | Gordon et al. | |
| 5,524,779 | A | 6/1996 | Faile | |
| 5,787,839 | A | 8/1998 | Magnant et al. | |
| 5,911,764 | A | 6/1999 | Wei Kong | |
| 6,612,455 | B2 | 9/2003 | Byrne | |
| 6,912,878 | B2 | 7/2005 | Belden, Jr. | |
| 6,988,642 | B2 | 1/2006 | Gallo, Jr. et al. | |
| 7,175,038 | B2 | 2/2007 | Dolan | |
| 7,252,204 | B1 | 8/2007 | Small | |
| 7,350,655 | B2 | 4/2008 | Belden, Jr. | |
| 7,397,375 | B2 | 7/2008 | Marsilio et al. | |
| 2005/0263411 | A1 | 12/2005 | Harrington | |
| 2006/0255052 | A1 * | 11/2006 | Svitak | 220/780 |

* cited by examiner

*Primary Examiner* — Anthony Stashick
*Assistant Examiner* — Elizabeth Volz
(74) *Attorney, Agent, or Firm* — The Marbury Law Group, PLLC

(57) ABSTRACT

A safety dish forms a secure food container and has a dish for holding food, a cover for enclosing the dish and food, and a lock mechanism for securing the cover to the dish to prevent unauthorized access to the food and/or tampering with the food. A key or correct input of a combination is required to access the food contents of the container. The safety dish and locking mechanism is preferably formed from dishwasher-safe and microwave-safe materials.

18 Claims, 6 Drawing Sheets

PORTABLE SAFETY DISH

RELATED APPLICATIONS

This application is a Continuation-in-Part of U.S. application Ser. No. 12/327,281, filed Dec. 3, 2008, now U.S. Pat. No. 8,201,705, which claims the benefit of Provisional Application Ser. No. 60/992,017 filed Dec. 3, 2007, both of which are hereby incorporated by reference.

BACKGROUND

While many food containers have lids that snap or "lock" onto the container to retain the food inside the container (e.g., Tupperware® and VERSAtainer™), these containers do not secure the food from unauthorized access or tampering.

The issues of tampering and access have been addressed in the prior art with respect to bottles for medications and the like through the use of child-proof caps and single-use tamper-indicating rings, tabs, foils and the like, as well as locking medicine cabinets.

While medications have been determined to be worthy of such means for protection from tampering and access, the prior art has not considered meal dishes to be worthy of protection from tampering and unauthorized access.

BRIEF SUMMARY

The disclosed embodiments provide a portable food container that includes a lock mechanism to secure the stored food from unauthorized access and/or tampering. The food container has a lower dish portion that holds the food, a cover, and a lock mechanism to secure the cover to the dish. The cover can optionally include a handle to aid in portability and handling, and the dish, cover, lock and handle are preferably microwave-safe and dishwasher-safe.

As used herein, the term "dish" refers to any dish, plate, bowl or the like used to hold a meal, pie, cake, or other food item. The terms "cover," "top" or "lid" refer to any device used to cover the open-top of the dish to prevent access to and tampering with the inside of the food container. The term "lock mechanism" refers to devices that cannot be opened without a "key," wherein the term "key" comprises physical keys, magnetic keys, combinations, biometrics, and other similar reusable devices used to control access.

DETAILED DESCRIPTION

Figure 1:
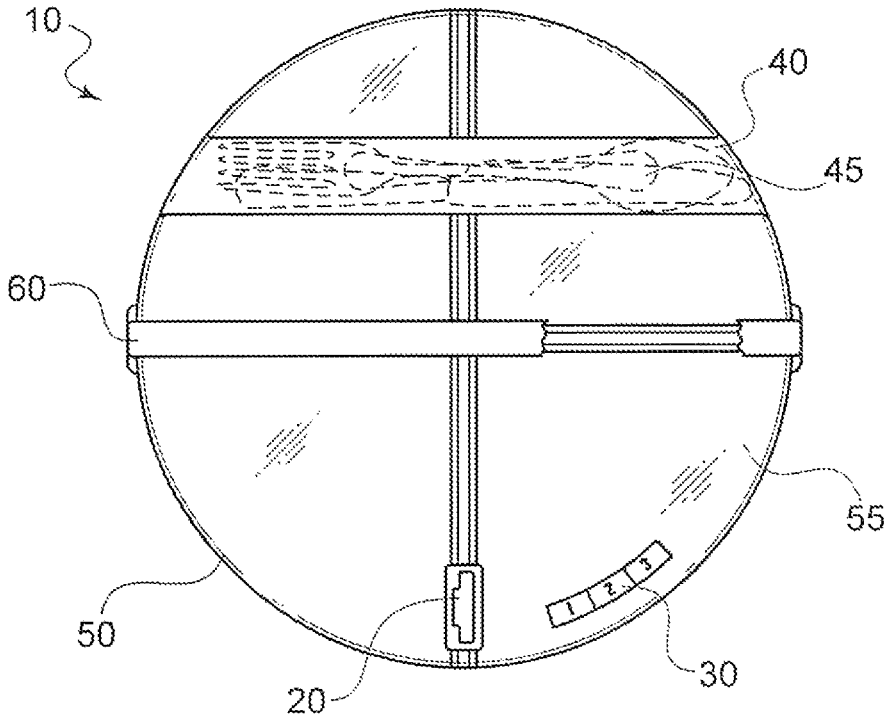
FIG. 1 illustrates a top view of a first embodiment.
Figure 2:
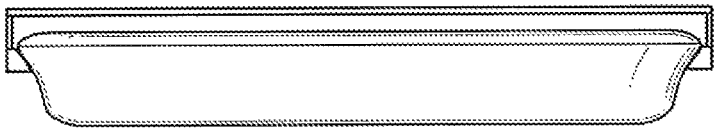
FIG. 2 illustrates a side view of the first embodiment.
Figure 3:
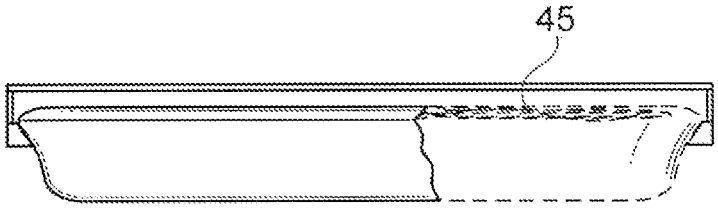
FIG. 3 illustrates a cut-away side view of the first embodiment.

With reference to FIGS. 1-3, a first embodiment of a safety dish 10 is illustrated. In the top-view of FIG. 1, the safety dish 10 forms a secure food container. The lid or cover 50 can optionally be clear (as illustrated) and is secured to the multi-compartment dish 55 of the container with a keyed lock 20 or a combination lock 30 so as to prevent access or tampering with the contents. The cover 50 can optionally include a utensil storage compartment 40, preferably accessible only from the underside of the cover 50 so as to store utensils 45 in a secure manner, as illustrated in FIG. 3. While the utensil storage compartment 40 can be used to hold any type of utensil, it may be preferable to supply a set formed of microwave-safe and dishwasher-safe material as part of the safety dish 10.

The safety dish 10 can include a handle 60 for carrying and handling purposes. The handle 60 can be attached to either the dish 55 or the cover 50 and can be removable or integral. One manner of making the handle 60 removable is illustrated in FIGS. 1-3. In this embodiment, a central portion of the handle 60 is able to flex. Either end of the handle 60 includes gripping portions that rotate inward and are further pressed into the dish when the handle 60 is lifted, but which rotate outward and ease their grip when the handle 60 is pushed down so as to let the handle 60 be removed. One of skill in the art will recognize that many other means can also be used to make the handle 60 selectively removable without departing from the claimed invention.

Figure 4:
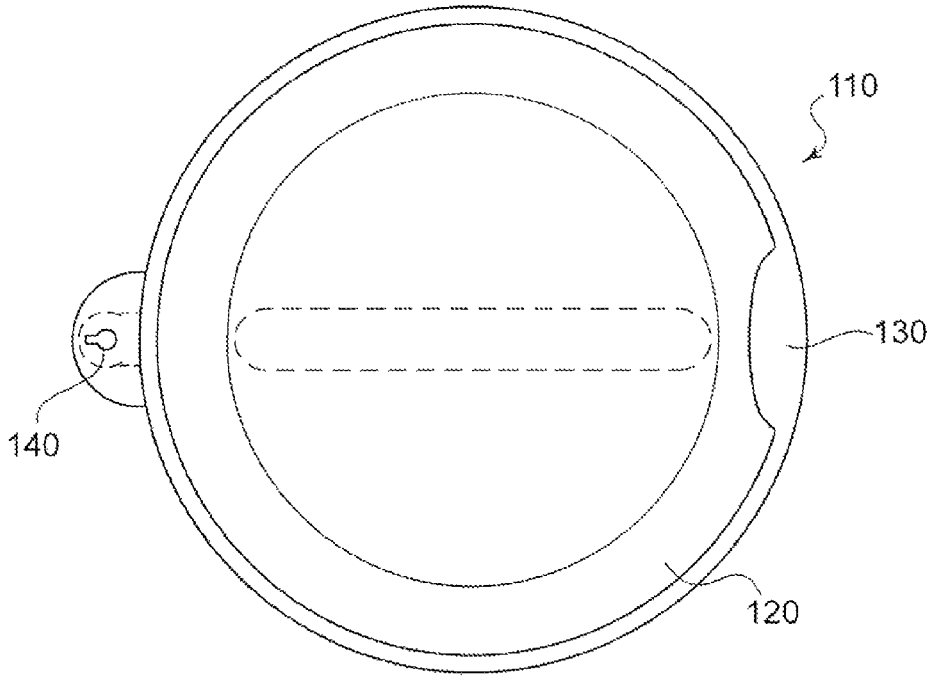
FIG. 4 illustrates a top view of a dish of a second embodiment.
Figure 5:
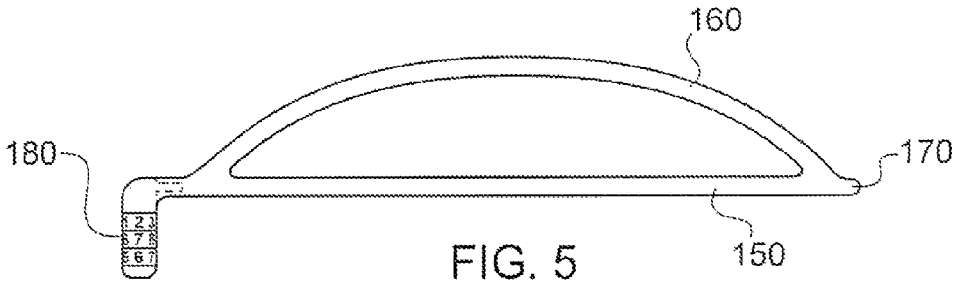
FIG. 5 illustrates a sectional side view of a cover of the second embodiment.
Figure 6:
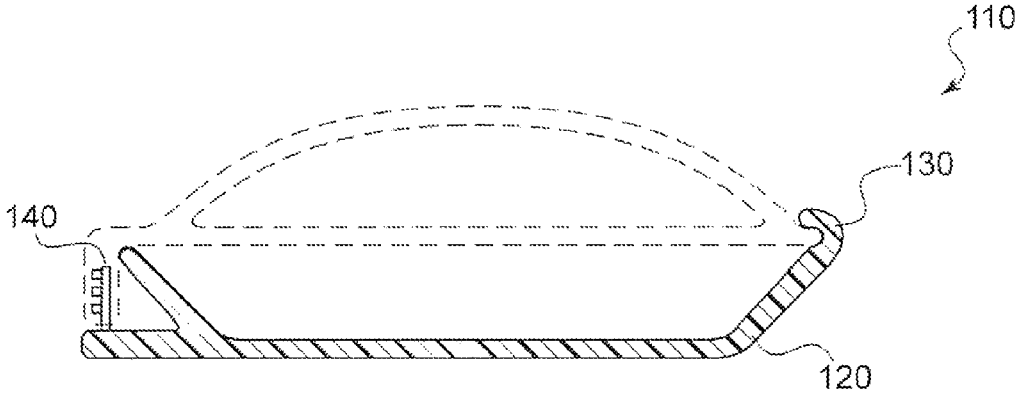
FIG. 6 illustrates a sectional side view of the dish of the second embodiment.

With reference to FIGS. 4 and 6, a top view and side view of a second embodiment of safety dish 110 is illustrated, with the cover shown in phantom so as to illustrate details of the dish 120. While illustrated as generally circular, the dish 120 can take any practical shape, including but not limited to ovals, ovoids (egg-shapes), squares, rectangles, triangles, pentagons, etc. The sidewalls of dish 120 can be angled (as illustrated) or vertical (not shown) or curved (not shown). A recess 130 engages a first portion of a lid or cover and a toothed pin 140 engages another portion of the lid or cover. The lid or cover 150 is illustrated in FIG. 5 and includes a portion or tab 170 that fits into recess 130. At an opposite side of the cover 150, a set of rotating dials 180 with notches is provided to engage with the toothed pin 140 to form a combination lock mechanism. While illustrated as having rotating dials 180 on the cover 150 and toothed pin 140 on the dish 120, it is also possible to have the rotating dial portion of the lock on the dish and the toothed pin portion of the lock on the cover. Similarly, the positions of the tab 130 and recess 170 can also be reversed.

The cover 150 can optionally include a handle 160 and a utensil storage compartment (not shown). If the handle 160 is oriented in line with the lock/tab/recess, it will add strength to the cover 150 to resist against "jimmying" of the lock. The handle 160 illustrated in FIG. 5 is integral with the cover and is preferably formed from dishwasher-safe and microwave-safe material (glass, ceramic, plastic, etc.). When used in a microwave, the handle 160 is preferably fabricated so that it will remain cool to allow a user to grasp the handle 160 to remove the safety dish 110 from the microwave after heating. The dish 120 and elements 140 and 180 of the lock mechanism are also preferably formed from dishwasher-safe and microwave-safe materials. Further, if the lock is not microwave-safe (i.e., metal), the lock can be removable, with a first element 180 horizontally removable and the second element 140 vertically removable so that, despite being removable, they keep each other securely in place when locked together.

Figure 7:
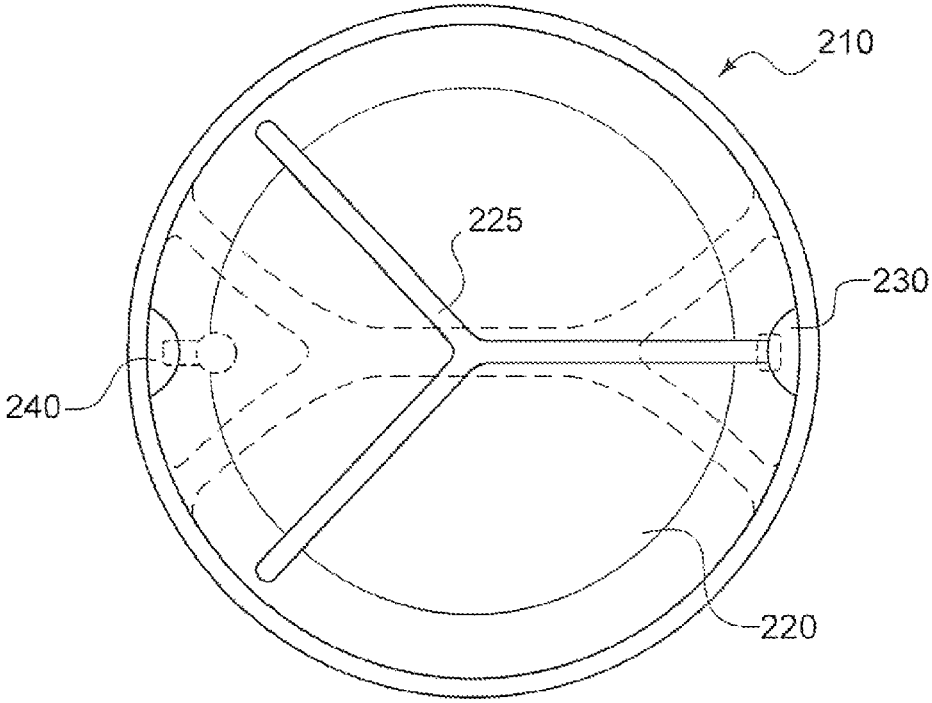
FIG. 7 illustrates a top view of a dish of a third embodiment.
Figure 8:
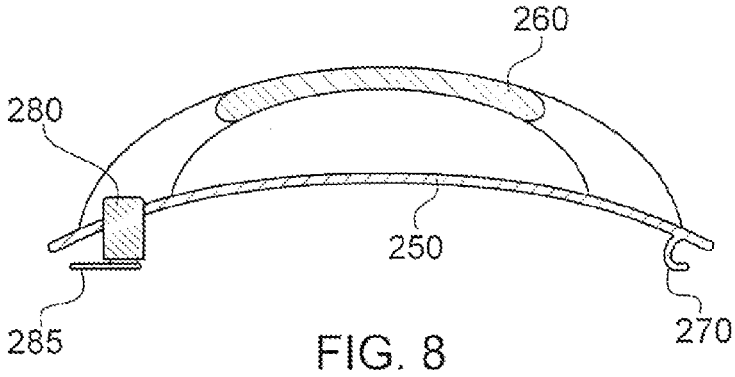
FIG. 8 illustrates a sectional side view of a cover of the third embodiment.
Figure 9:
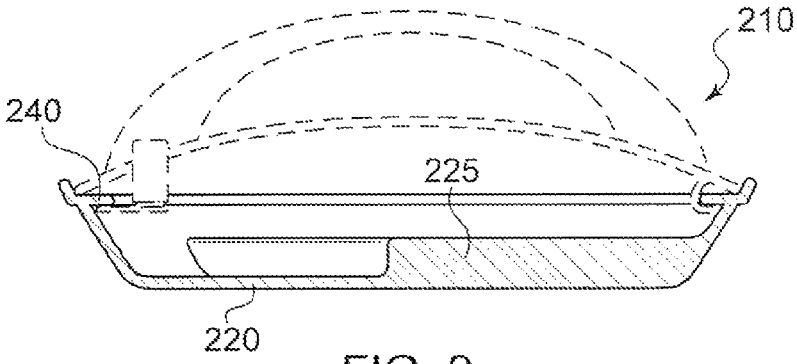
FIG. 9 illustrates a sectional side view of the dish of the third embodiment.

With reference to FIGS. 7 and 9, a top view and side view of a third embodiment of safety dish 210 is illustrated, with the cover shown in phantom so as to illustrate details of the dish 220. While illustrated as generally circular, the dish 220 can take any practical shape, including but not limited to ovals, ovoids (egg-shapes), squares, rectangles, triangles, pentagons, etc. and can include one or more dividing walls 225 to separate food items. The sidewalls of dish 220 can be angled (as illustrated) or vertical (not shown) or curved (not shown). A tab 230 engages a first portion of a lid or cover and a tab 240 engages another portion of the lid or cover. The lid or cover 250 is illustrated in FIG. 8 and includes a portion or recess 270 that engages tab 230. At an opposite side of the cover 250, a keyed lock cylinder 280 with a rotating latch 285 is provided to engage with the tab 240 to form a keyed lock mechanism. While illustrated as having lock cylinder 280 on the cover 250 and tab 240 on the dish 220, it is also possible to have the cylinder and latch portion of the lock on the dish and the engaged portion of the lock on the cover. Similarly, the positions of the tab 230 and recess 270 can also be reversed.

The cover 250 can optionally include a handle 260 and a utensil storage compartment (not shown). The handle 260 illustrated in FIG. 8 is integral with the cover. The handle 260 can take any suitable form and may be foldable or removable. As illustrated, the handle 260 splits into two sections at either end and is preferably formed from dishwasher-safe and microwave-safe material (glass, ceramic, plastic, etc.). When used in a microwave, the handle 260 is preferably fabricated so that it will remain cool to allow a user to grasp the handle 260 to remove the safety dish 210 from the microwave after heating. The dish 220 and elements 240 and 280/285 of the lock mechanism are also preferably formed from dishwasher-safe and microwave-safe materials. Further, if the lock is hot microwave-safe (i.e., metal), the cylinder/latch portion of the lock can be removable from the inside so that it remains securely in place when locked.

Figure 10:
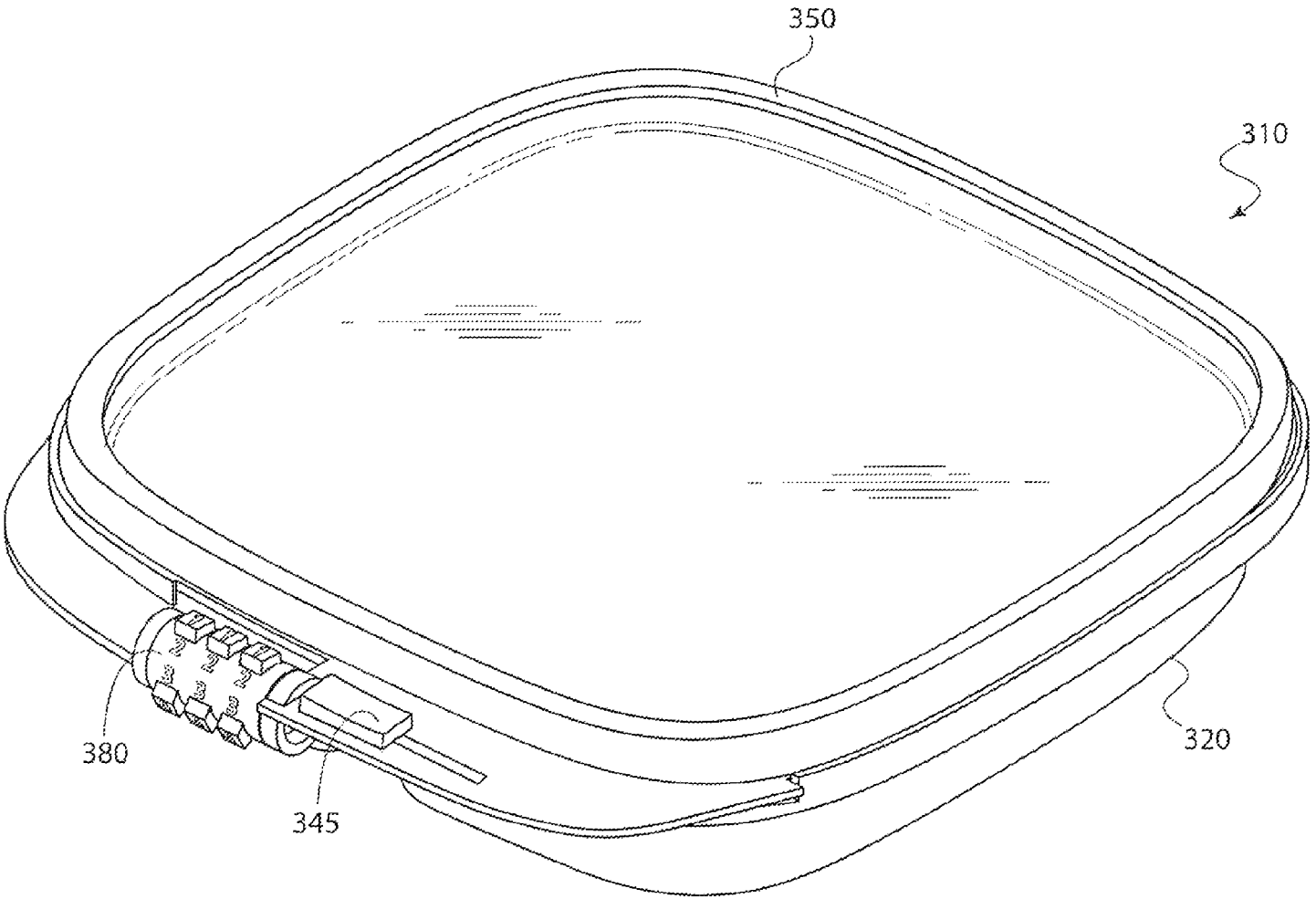
FIG. 10 illustrates an isometric view of a fourth embodiment of a food container.
Figure 11:
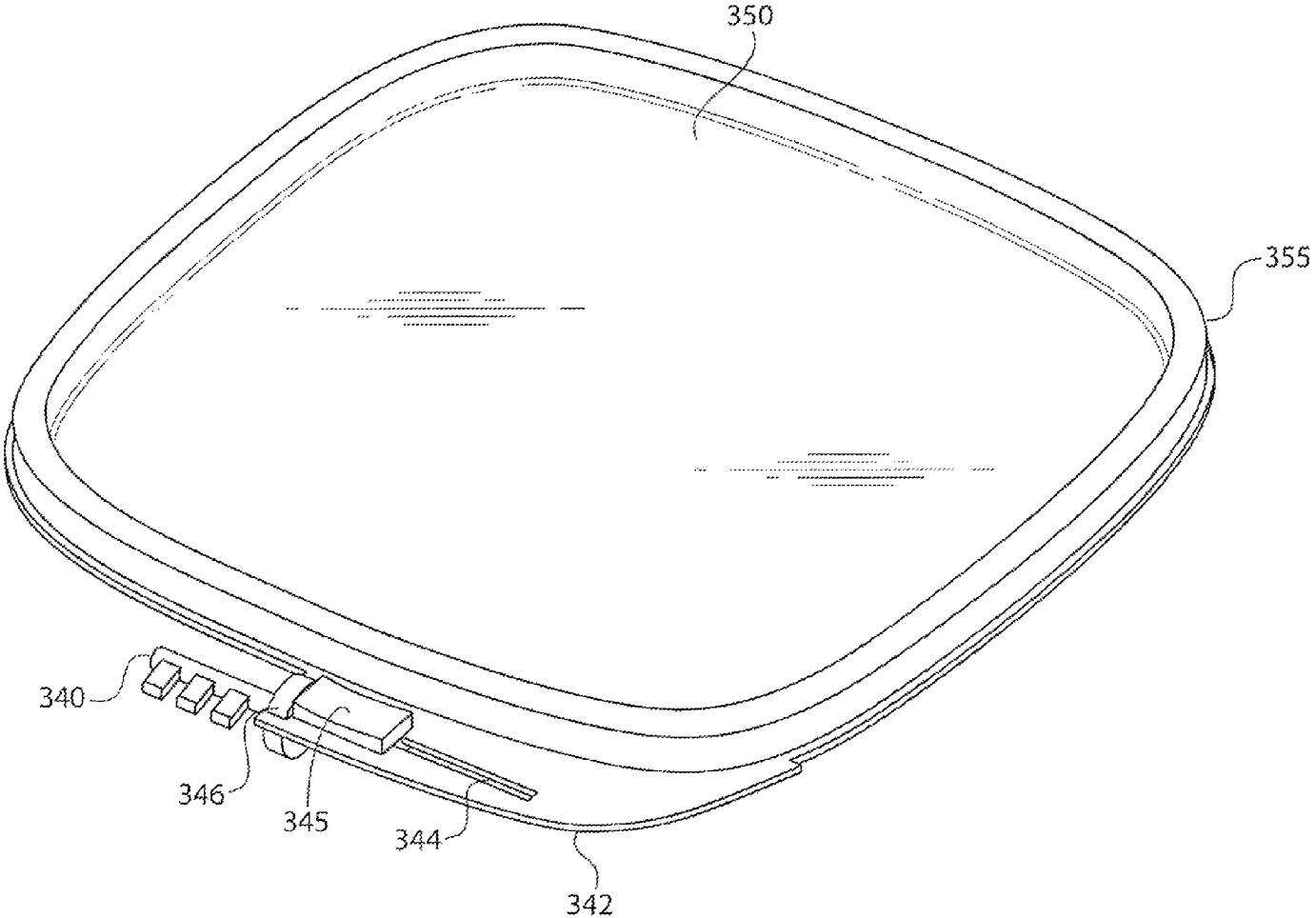
FIG. 11 illustrates an isometric view of a cover of the fourth embodiment.
Figure 12:
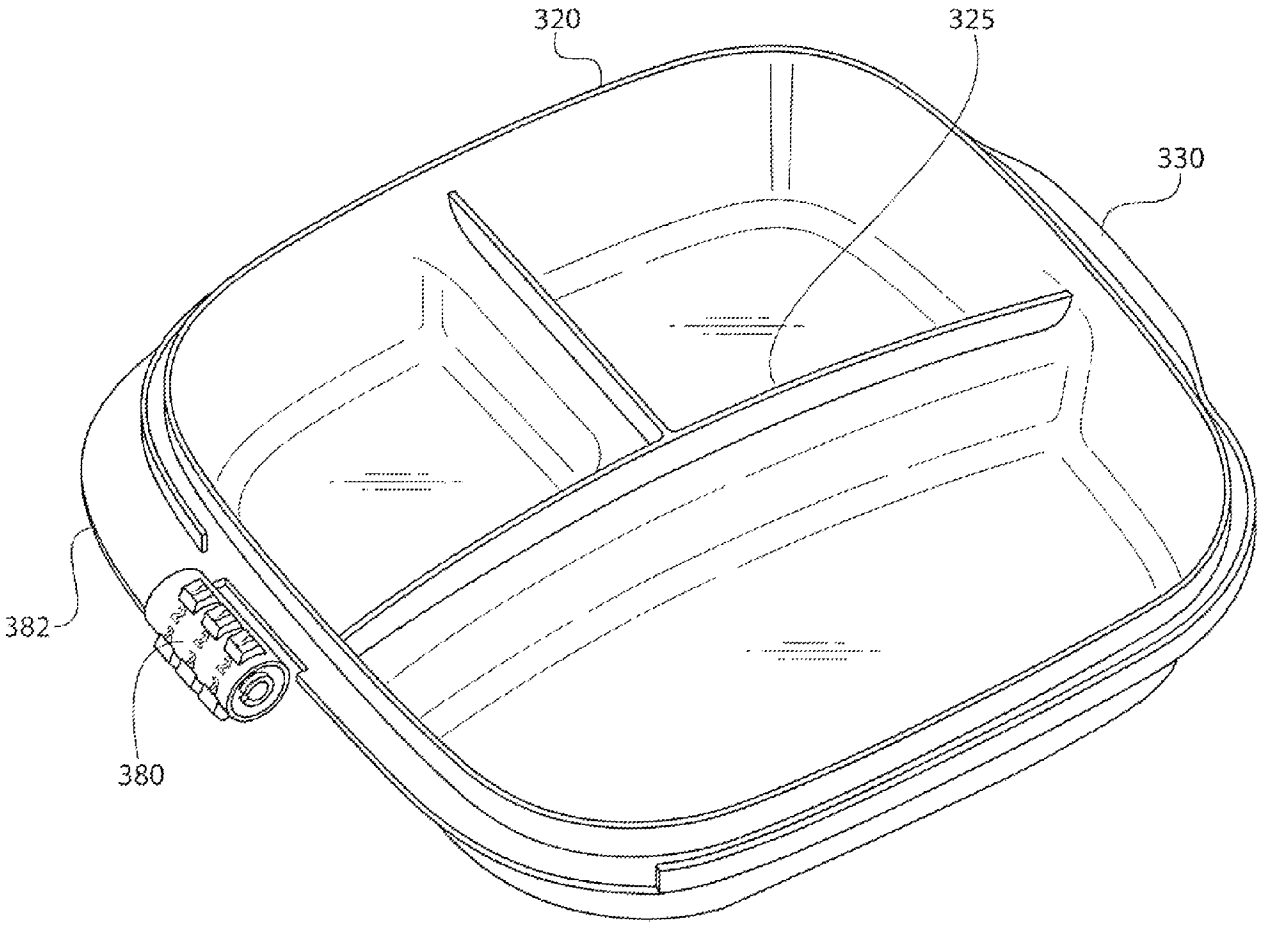
FIG. 12 illustrates an isometric view of the lower dish of the fourth embodiment.

With reference to FIGS. 10-12, a fourth embodiment of a safety dish 310 is illustrated. FIG. 10 illustrates an isomeric view of the fourth embodiment of safety dish 310, wherein a multi-dial combination lock mechanism is formed integral with the components of the safety dish 310. While illustrated as generally square, the lower dish 320 and cover 350 can take any practical shape, including but not limited to ovals, ovoids (egg-shapes), circles, rectangles, triangles, pentagons, etc. The sidewalls of lower dish 320 can be angled or vertical or curved. A toothed pin 340 (obscured in FIG. 10) of the multi-dial combination lock mechanism is mounted to slide mechanism 345 secured to cover 350. The slide mechanism 345 comprises an actuation element that a user engages and is positioned to move the toothed pin 340 into and out of a set of rotating dials 380 of the multi-dial combination lock mechanism. The rotating dials 380 are mounted in a rotatable manner on a hollow support shaft (not shown) having a C-shaped cross-section. The opening in the C-shaped support shaft is sized to accommodate the toothed pin 340. The hollow support shaft and the rotating dials 380 are mounted on an adjacent edge portion of lower dish 320 so as to mate with the toothed pin 340 to form the multi-dial combination lock mechanism. The lid or cover 350 can optionally include a portion or tab (not illustrated) on the side opposite the slide mechanism that fits into recess or retainer (not illustrated) on an adjoining portion of lower dish 320 so as to prevent prying open of the lid from the side opposite the locking mechanism. While illustrated as having rotating dials 380 on the lower dish 320 and toothed pin 340 and slide mechanism 345 oh the cover 350, it is also possible to have the rotating dial 380 portion of the lock on the cover 350 and the toothed pin 340 and sliding mechanism 345 portion of the lock on the lower dish 320.

With reference to FIG. 11, an isomeric view of a cover 350 of the fourth embodiment of safety dish 310 is illustrated. The cover 350 preferably includes a rim portion 355 for engaging an upper wall of the lower dish 320. One edge of cover 350 includes a planar portion 342 that includes a linear slot 344 for engaging slide mechanism 345. While illustrated as extending from the edge, planar portion 342 may also be formed integral with the edge. Furthermore, slot 344 may also be replaced by similar sliding mechanisms, such as mechanisms using retaining rails instead of a slot. The slot 344 terminates at one end with a retainer element 346. The actuation element of slide mechanism 345 is connected via a support element (not shown) to toothed pin 340, through slot 344 in the present case. The actuation element of slide mechanism 345 is positioned so as to enable a user to slide the toothed pin 340 into a first position that engages the rotating dial 380 portion of the multi-dial combination lock mechanism when the cover 350 is in a position sealing the lower dish 320, and slide the toothed pin 340 into a second position free from the rotating dial 380 portion of the lock so that the cover 350 may be removed from the lower dish 320 for access to the contents stored in the safety dish 310. Further, while positioned to be slidable, the toothed pin 340 must be secured to the cover 350 in a secure manner so as to prevent bypassing the security of the safety dish 310.

The lower dish 320 of the fourth embodiment of the safety dish 310 is illustrated in FIG. 12. The lower dish 320 may have no walls or can optionally include one or more inner walls 325 so as to form a plurality of food storage compartments. In this manner, separate food items can be kept separate during transport and storage of the safety dish 310. Such walls 325 can also provide additional strength and rigidity to the lower dish 320. The lower dish 320 can also optionally include a lip portion 330 on one or more sides to aid in handling of the dish. An optional recess or retainer element as discussed above with respect to FIG. 10 can be formed as part of lip portion 330 to engage a portion or tab on cover 350 to prevent prying open of the cover 350 from the side opposite the locking mechanism. One edge of lower dish 320 includes a planar portion 382 for supporting the rotating dial 380 portion of the lock mechanism. Although not illustrated, the rotating dials 380 are supported on a hollow, C-shaped support shaft that is rigidly attached to or extending from planar portion 382. While illustrated as extending from the upper wall of lower dish 320, planar portion 382 may also be formed in any suitable manner that rigidly and securely positions the rotating dial 380 portion of the lock mechanism in the correct position for engaging the toothed pin 340 for securing the cover 350 to the lower dish 320. However, a preferred embodiment of planar portions 382 and 342 form a lip to aid in handling of the safety dish 310. The lower dish 320, cover 350, and elements 340, 345, 346 and 380 of the lock mechanism are formed of sufficiently rigid materials, such as plastic (e.g., Lexan® polycarbonate), glass (e.g., Pyrex® borosilicate glass), or ceramic (e.g., Ceramcor®), to resist tampering. The materials of these elements are also preferably formed from dishwasher-safe and microwave-safe materials.

In general, the materials used for the safety dish should have sufficient strength and stiffness to prevent the cover or lock from being "jimmied" open. Further, while the disclosed combination lock will suffice for ordinary situations such as preventing theft from a common workplace lunchroom refrigerator, such locks are susceptible to defeat from a brute-force approach of trying all permutations or from inspection while in a dishwasher to discover the combination. For greater security, more secure locks should be used.

In a basic embodiment, the safety dish comprises a dish with a base and side walls, a cover for the dish dimensioned to engage the side walls to enclose a food storage area, and a lock mechanism positioned to secure the cover to the dish to prevent unauthorized access to the food storage area. Variations of this embodiment include those wherein: the lock mechanism is selected from a group consisting of a combination lock and a keyed lock, the dish further comprises divider walls to separate food items, the cover further comprises an upwardly extending handle, and those wherein the dish, cover and lock mechanism are formed from microwave-safe materials or dishwasher-safe materials. The basic form can also include a utensil storage compartment, wherein the utensil storage compartment is preferably positioned in the food storage area so as to prevent access and tampering with stored utensils.

In a more particular embodiment, the safety dish comprises a dish with a base and side walls, a cover for the dish dimensioned to engage the side walls to enclose a food storage area, a lock mechanism positioned to secure the cover to the dish to prevent unauthorized access to the food storage area, and further includes a tab on one side of the cover and a first side of the lock mechanism positioned at an opposite side of the cover and a recess on one side of the dish for engaging the tab and a second side of the lock mechanism positioned at an opposite side of the dish to engage the first side of the lock mechanism when the cover is attached to the dish. More particularly, the lock mechanism can be a combination lock comprising a toothed pin that engages rotating dials with notches. Optionally, the cover can include an upwardly extending handle. The materials are preferably dishwasher-safe and microwave-safe.

In another more particular embodiment, the safety dish again comprises a dish with a base and side walls, a cover for the dish dimensioned to engage the side walls to enclose a food storage area, a lock mechanism positioned to secure the cover to the dish to prevent unauthorized access to the food storage area, and further includes a recess on one side of the cover and the lock mechanism positioned at an opposite side of the cover and a pair of tabs on opposite sides of the dish for engaging the recess and the lock mechanism when the cover is attached to the dish. Preferably, the lock mechanism is a key lock comprising a rotating latch that engages a tab on the dish to secure the cover to the dish. Optionally, the cover can include an upwardly extending handle. The materials are preferably dishwasher-safe and microwave-safe.

In another embodiment, the safety dish comprises a dish with a base, side walls, and a first portion of a locking mechanism; and a cover for the dish, the cover dimensioned to engage a top of the side walls to enclose a food storage area, and the cover further comprising a second portion of the locking mechanism, wherein the first and second portions of the lock mechanism form a multi-dial combination lock, with one side of the lock mechanism comprising a toothed pin mounted on a sliding mechanism. Preferably, the first portion of the locking mechanism comprises a hollow support shaft with a C-shaped cross-section fixed to a side wall of the dish; and a plurality of rotating dials mounted to rotate on the hollow support shaft, with each dial having notch. The second portion of the locking mechanism preferably comprises the toothed pin mounted on the sliding mechanism, wherein the second portion is positioned on the cover so as to allow the sliding mechanism to move the toothed pin into and out of the hollow support shaft of the first portion when the cover is engaged with the top of the side walls of the dish and the notches of the plurality of dials are aligned. Variations of this embodiment include those wherein the sliding mechanism comprises a planar support; a linear slot formed in the planar support; an actuation element; and a support element joining the toothed pin to the actuation element through the linear slot. Other variations may comprise corresponding tab and retaining elements on the cover and dish on a side of the safety dish opposite the locking mechanism. Preferably, the dish, cover and lock mechanism of these embodiments are formed from dishwasher-safe materials.

A safety dish in the form of a locking food container has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the," is not to be construed as limiting the element to the singular.

What is claimed is:

1. A safety dish, comprising:

a dish comprising a base, side walls, and a first portion of a locking mechanism; and a cover for the dish, the cover dimensioned to engage a top of the side walls to enclose a food storage area, and the cover further comprising a second portion of the locking mechanism, wherein the first and second portions of the lock mechanism form a multi-dial combination lock, with one side of the lock mechanism comprising a toothed pin mounted on a sliding mechanism.

2. The safety dish of claim 1, wherein the second portion of the locking mechanism comprises:

a hollow support shaft with a C-shaped cross-section fixed to the cover; and a plurality of rotating dials mounted to rotate on the hollow support shaft, with each dial having notch; and wherein the first portion of the locking mechanism comprises the toothed pin mounted on the sliding mechanism, wherein the first portion is positioned on the dish so as to allow the sliding mechanism to move the toothed pin into and out of the hollow support shaft of the second portion when the cover is engaged with the top of the side walls of the dish and the notches of the plurality of dials are aligned.

3. The safety dish of claim 1, wherein the sliding mechanism comprises:

a planar support;

a linear slot formed in the planar support;

an actuation element; and a support element joining the toothed pin to the actuation element through the linear slot.

4. The safety dish of claim 1, further comprising corresponding tab and retaining elements on the cover and dish on a side of the safety dish opposite the locking mechanism.

5. The safety dish of claim 1, wherein the dish, cover and lock mechanism are formed from dishwasher-safe materials.

6. The safety dish of claim 1, wherein the dish further comprises at least one divider wall to separate food items.

7. The safety dish of claim 6, wherein the dish, cover and lock mechanism are formed from dishwasher-safe materials.

8. The safety dish of claim 1, wherein the cover further comprises a utensil storage compartment.

9. The safety dish of claim 8, wherein the utensil storage compartment is positioned in the food storage area so as to prevent access and tampering with stored utensils.

10. The safety dish of claim 9, further comprising utensils dimensioned for storage in the utensil storage compartment and formed from microwave-safe and dishwasher-safe material.

11. The safety dish of claim 1, wherein the first portion of the locking mechanism comprises:

a hollow support shaft with a C-shaped cross-section fixed to a side wall of the dish; and a plurality of rotating dials mounted to rotate on the hollow support shaft, with each dial having notch; and wherein the second portion of the locking mechanism comprises the toothed pin mounted on the sliding mechanism, wherein the second portion is positioned on the cover so as to allow the sliding mechanism to move the toothed pin into and out of the hollow support shaft of the first portion when the cover is engaged with the top of the side walls of the dish and the notches of the plurality of dials are aligned.

12. The safety dish of claim 11, further comprising:

a tab on a side of the cover opposite the second portion of the locking mechanism; and a retainer on a side of the dish opposite the first portion of the locking mechanism, the retainer dimensioned to engage the tab when the cover is attached to the dish.

13. The safety dish of claim 11, wherein the dish, cover and lock mechanism are formed from dishwasher-safe materials.

14. The safety dish of claim 11, wherein the sliding mechanism comprises:

a planar support;

a linear slot formed in the planar support;

an actuation element; and a support element joining the toothed pin to the actuation element through the linear slot.

15. The safety dish of claim 14, further comprising a lip formed on a side of the dish opposite the first portion of the locking mechanism to aid in handling of the safety dish.

16. The safety dish of claim 14, wherein the dish, cover and lock mechanism are formed from dishwasher-safe materials.

17. The safety dish of claim 14, further comprising:

a tab on a side of the cover opposite the second portion of the locking mechanism; and a retainer on a side of the dish opposite the first portion of the locking mechanism, the retainer dimensioned to engage the tab when the cover is attached to the dish.

18. The safety dish of claim 17, wherein the dish, cover and lock mechanism are formed from dishwasher-safe materials.

* * * * *